US009114864B2

(12) United States Patent
Schlintz

(10) Patent No.: US 9,114,864 B2
(45) Date of Patent: Aug. 25, 2015

(54) MARINE POD HULL SEAL ASSEMBLY

(71) Applicant: Caterpillar Inc., Peoria, IL (US)

(72) Inventor: John C. Schlintz, Milwaukee, WI (US)

(73) Assignee: Caterpillar Inc., Peoria, IL (US)

( * ) Notice: Subject to any disclaimer, the term of this patent is extended or adjusted under 35 U.S.C. 154(b) by 85 days.

(21) Appl. No.: 13/959,170

(22) Filed: Aug. 5, 2013

(65) Prior Publication Data

US 2015/0038028 A1 Feb. 5, 2015

(51) Int. Cl.
*B63H 20/02* (2006.01)
*B63H 5/10* (2006.01)

(52) U.S. Cl.
CPC ..... *B63H 20/02* (2013.01); *B63H 5/10* (2013.01); *B63H 2020/025* (2013.01)

(58) Field of Classification Search
CPC ..... B63H 23/321; B63H 20/02
USPC ..... 440/112, 111
See application file for complete search history.

(56) References Cited

U.S. PATENT DOCUMENTS 3,982,496 A * 9/1976 Blanchard ..... 440/52
4,040,378 A * 8/1977 Blanchard ..... 440/52
4,236,478 A 12/1980 Mansson
6,179,674 B1 1/2001 Eichinger et al.
6,814,637 B1 * 11/2004 Quaeck ..... 440/112
7,118,434 B2 * 10/2006 Arvidsson et al. ..... 440/88 C
7,182,657 B2 * 2/2007 Mansson ..... 440/52
7,294,031 B1 11/2007 Davis et al.
7,387,556 B1 * 6/2008 Davis ..... 440/89 A
7,584,934 B1 * 9/2009 Eichinger ..... 248/640
7,690,959 B1 * 4/2010 Szilagyi et al. ..... 440/52
8,506,338 B2 * 8/2013 Gallato et al. ..... 440/112
8,740,662 B2 * 6/2014 Gallato et al. ..... 440/112
8,808,045 B2 * 8/2014 Lundqvist et al. ..... 440/89 G
2010/0297896 A1 11/2010 Duncan
2011/0195619 A1 * 8/2011 Davis et al. ..... 440/75
2011/0294378 A1 12/2011 Gallato et al.
2015/0038028 A1 * 2/2015 Schlintz ..... 440/112

FOREIGN PATENT DOCUMENTS

WO WO-2012/038305 A1 3/2012

* cited by examiner

*Primary Examiner* — Lars A Olson
*Assistant Examiner* — Jovon Hayes
(74) *Attorney, Agent, or Firm* — Miller, Matthias & Hull LLP

(57) ABSTRACT

A hull seal assembly securing a drive unit within an opening in a boat hull may include a lower housing section, an upper housing section and an intermediate housing section of the drive unit, with the intermediate housing section having an outwardly extending retention portion. The hull seal assembly further includes a hull support ring mounted to a bottom of the boat hull and surrounding the opening and a clamp ring installed around the drive unit. with the hull support ring having a downwardly facing support ring surface; and fastened to the hull support ring and having an upwardly facing clamp ring surface. The outwardly extending retention portion may be disposed between a downwardly facing support ring surface and an upwardly facing clamp ring surface to retain the outwardly extending retention portion of the drive unit within the hull support ring.

19 Claims, 5 Drawing Sheets

MARINE POD HULL SEAL ASSEMBLY

TECHNICAL FIELD

This disclosure relates generally to watercraft hulls with bottom-mounted drive units for at least one propeller and, in particular, to securely mounting drive units to the watercraft hulls while minimizing vibration and preventing leakage.

BACKGROUND

In personal and commercial watercraft, such as engine-driven fishing boats and speedboats, propulsion systems are often used in which a drive engine of the watercraft is arranged inside the watercraft and is actively connected, via a drive unit in the area of the watercraft's hull, to one or more propellers on the outside of the watercraft's hull. The drive unit typically passes through an opening in the hull or rear transom of the watercraft's hull, and usually includes an upper housing section or gear and clutch housing disposed inside the hull and having a drive shaft connected to an output shaft of the engine, and a lower housing section or underwater housing disposed outside the hull and having one or more output shafts connected to one or more propellers that rotate to drive the watercraft through the water. To avoid having the watercraft take on water through the opening in the hull, the drive unit must be secured within the opening with an arrangement that provides a sufficiently water-tight seal to prevent leakage when the watercraft is disposed and operated in the water.

One example of a known sealing arrangement is provided in U.S. Pat. No. 7,182,657, issued Feb. 27, 2007 to Mansson, which discloses a mounting arrangement wherein a boat hull is formed with a vertical well having an internal flange. The boat hull is used with a drive unit having a vertical drive shaft with an underwater housing connected to an upper gear housing, with the upper gear housing having a horizontal drive shaft for connection to an engine. A mounting plate of a drive unit and a screw-down plate are fastened to opposite sides of the internal flange, with compressible rings between surfaces of the mounting plate and the flange and between surfaces of the screw-down plate and the flange. The rings dampen vibrations from the drive to the hull. The propeller forces are transmitted via the mounting plate and the screw-down plate to the flange and the well and, thus, to the boat hull. The sealing arrangement of the Mansson patent may be effective in mounting the drive unit with the boat hull opening, but opportunities still exist for further improvements to such sealing arrangements.

SUMMARY OF THE DISCLOSURE

In one aspect of the present disclosure, a boat hull with a bottom-mounted drive unit for at least one propeller is disclosed. The boat hull and bottom-mounted drive unit may include a lower housing section of the bottom-mounted drive unit, an upper housing section of the bottom-mounted drive unit, and an intermediate housing section of the bottom-mounted drive unit disposed between the lower housing section and the upper housing section, with the intermediate housing section having an outwardly extending retention portion. The boat hull and bottom-mounted drive unit may also include a hull support ring mounted to a bottom of the boat hull and surrounding an opening through the bottom of the boat hull, with the hull support ring having a downwardly facing support ring surface; and a clamp ring fastened to the hull support ring and having an upwardly facing clamp ring surface. The outwardly extending retention portion may be disposed between the downwardly facing support ring surface and the upwardly facing clamp ring surface to retain the outwardly extending retention portion of the bottom-mounted drive unit within the hull support ring.

In another aspect of the present disclosure, a bottom-mounted drive unit for installation in an opening of a boat hull is disclosed. The bottom-mounted drive unit may include a lower housing section, an upper housing section, and an intermediate housing section disposed between the lower housing section and the upper housing section. The intermediate housing section may have an outwardly extending retention portion with an upwardly facing lateral edge surface and a downwardly facing lateral edge surface, wherein the upwardly facing lateral edge surface and the downwardly facing lateral edge surface are engaged by a hull seal assembly to retain the bottom-mounted drive unit within the opening of the boat hull.

In a further aspect of the present disclosure, a boat hull with a bottom-mounted drive unit for at least one propeller is disclosed. The boat hull and bottom-mounted drive unit may include a lower housing section of the bottom-mounted drive unit, an upper housing section of the bottom-mounted drive unit, and an intermediate housing section of the bottom-mounted drive unit disposed between the lower housing section and the upper housing section, with the intermediate housing section having an outwardly extending retention portion with a tapered upwardly facing lateral edge surface and a tapered downwardly facing lateral edge surface. The boat hull and bottom-mounted drive unit may also include a hull support ring mounted to a bottom of the boat hull and surrounding an opening through the bottom of the boat hull, the hull support ring having a tapered downwardly facing support ring surface, and a clamp ring fastened to the hull support ring and having a tapered upwardly facing clamp ring surface. The outwardly extending retention portion may be disposed between the tapered downwardly facing support ring surface and the tapered upwardly facing clamp ring surface to retain the outwardly extending retention portion of the bottom-mounted drive unit within the hull support ring with the tapered downwardly facing support ring surface facing the tapered upwardly facing lateral edge surface of the outwardly extending retention portion and the tapered upwardly facing clamp ring surface facing the tapered downwardly facing lateral edge surface of the outwardly extending retention portion. The boat hull and bottom-mounted drive unit may further include an upper ring seal disposed between the tapered downwardly facing support ring surface and the tapered upwardly facing lateral edge surface, and a lower ring seal disposed between the tapered upwardly facing clamp ring surface and the tapered downwardly facing lateral edge surface.

Additional aspects are defined by the claims of this patent.

DETAILED DESCRIPTION

Although the following text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined in this patent using the sentence "As used herein, the term '_____' is hereby defined to mean, . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning.

Figure 1:
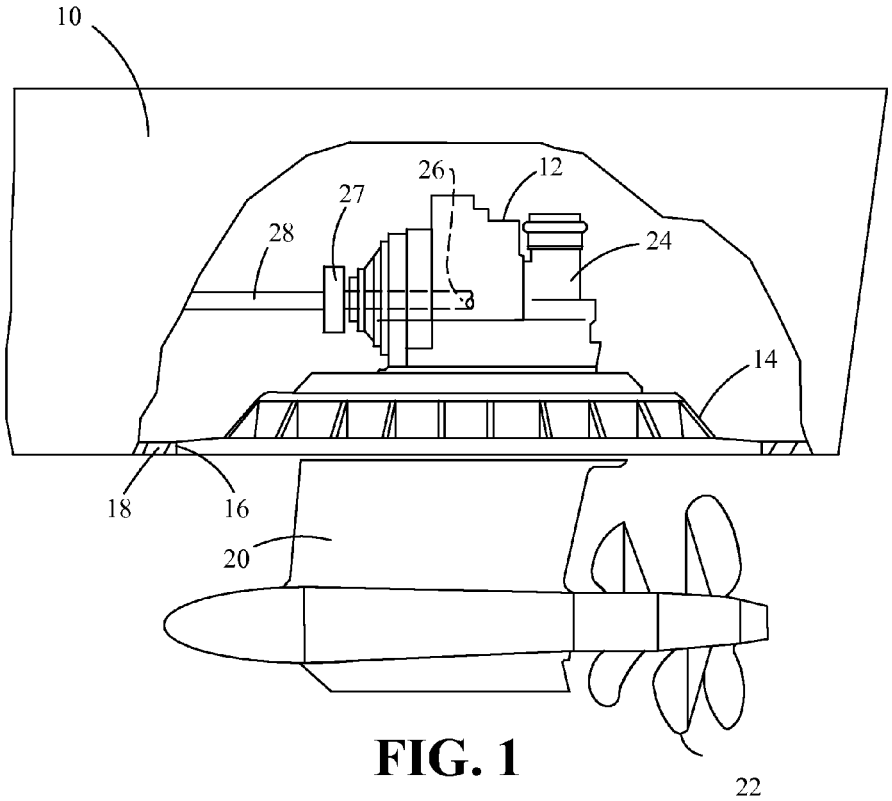
FIG. 1 is a side view of an aft portion of a boat hull with a bottom-mounted drive unit secured thereto with a portion of the boat hull removed to reveal the drive unit and a hull seal assembly in accordance with the present disclosure.

FIG. 1 illustrates an aft portion of a boat hull 10 having a portion removed to expose an inboard portion of a drive unit 12 and a hull seal assembly 14 securing the drive unit 12 within an opening 16 through a bottom wall 18 of the boat hull 10. The boat hull 10 may be formed by casting fiberglass reinforced polyester plastic or by fabricating other appropriate materials to form the shape of the boat hull 10. The drive unit 12 may include a lower or underwater housing section 20 disposed in the water below the bottom wall 18 and the hull seal assembly 14. The underwater housing section 20 may house concentric propeller shafts (not shown) having rotatably mounted individual propellers 22 that may counter-rotate to propel the watercraft though the water.

The drive unit 12 may further include an upper gear housing section 24 disposed within the boat hull 10 and having a horizontal input shaft 26 extending there from connected by an input flange 27 via a splined connection to a drive shaft 28 from the boat's engine (not shown). The input shaft 26 may drive the propeller shafts and, correspondingly, the propellers 22 via gearing (not shown) within the gear housing section 24 connecting the input shaft 26 to a vertical shaft (not shown) extending through the housing sections 20, 24 and an intermediate housing section 40 (FIGS. 2 and 3) to additional gearing (not shown) connecting the vertical shaft to the propeller shafts in the underwater housing section 20. As illustrated, the propellers 22 are disposed aft of the underwater housing section 20 and push the watercraft through the water. However, those skilled in the art will understand that the drive unit 12 may be configured with the propellers 22 disposed forward of the underwater housing section 20 and pull the watercraft forward through the water. Likewise, those skilled in the art will appreciate that the drive unit 12 may be configured with one or more of the propellers 22, and the disclosure is not limited to the drive unit 12 having two of the propellers 22. The propellers 22 may be of various shapes and sizes.

Figure 2:
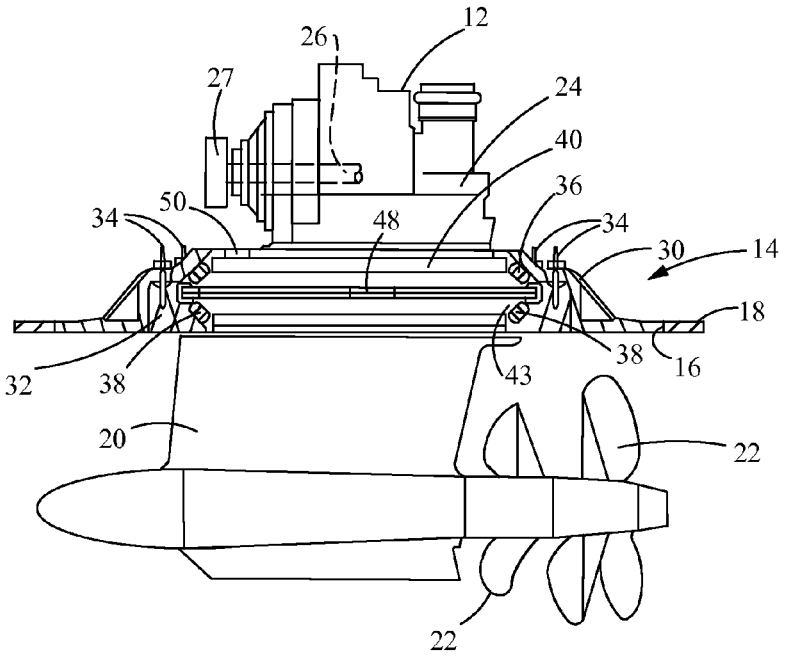
FIG. 2 is an assembly view of the boat hull and bottom-mounted drive unit of FIG. 1 with the components of the hull seal assembly shown in cross-section.

The hull seal assembly 14 is shown in greater detail in FIG. 2. The components of the hull seal assembly 14 are shown in cross-section while the drive unit 12 is illustrated in whole. The hull seal assembly 14 may include a hull support ring 30 mounted to the bottom 18 of the boat hull 10 and surrounding the opening 16. A clamp ring 32 may be installed around the drive unit 12 and fastened to the hull support ring 30 by studs 34 or other appropriate fasteners. An upper ring seal 36 and a lower ring seal 38 may be installed between corresponding surfaces of the drive unit 12, the hull support ring 30 and the clamp ring 32 to form substantially water-tight seals preventing leakage of water into the inboard compartment of the boat hull 10. In alternative embodiments, a sensor may be located adjacent to the upper ring seal 36 or the lower ring seal 38 to measure for leakage.

Figure 3:
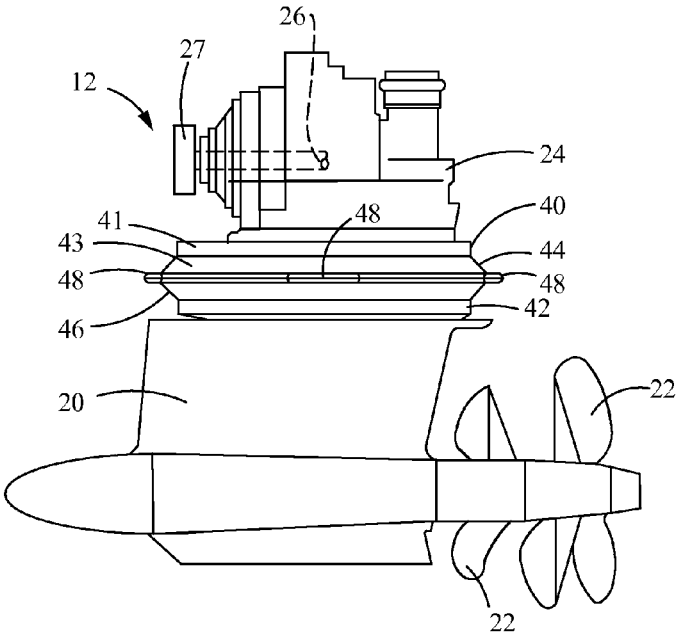
FIG. 3 is a side view of the drive unit of FIG. 1 detached from the boat hull.

FIG. 3 illustrates the drive unit 12 before installation in the opening 16 of the boat hull 10 and securement by the hull seal assembly 14. The underwater housing section 20 and the gear housing section 24 may be connected by an intermediate housing section 40 configured to be engaged by the hull support ring 30 and the clamp ring 32 of the hull seal assembly 14 to retain the drive unit 12 within the opening 16 in the boat hull 10. The intermediate housing section 40 has a shape when viewed from the top that is complimentary to the shapes of the opening 16 of the boat hull 10, the hull support ring 30 and the clamp ring 32. The intermediate housing section 40 may be formed by an upper plate 41 and a lower plate 42 connected together. The plates 41, 42 may be fabricated from the same material, such as aluminum, or may be formed from different materials where the material for the lower plate 42, such as bronze, may be more resistant to rust, corroding, or other degradation that may occur due to extended contact with the water in which the boat hull 10 is disposed. The intermediate housing section 40 may include an outwardly extending retention portion 43 formed by the plates 41, 42 and that may include an upwardly facing lateral edge surface 44 on the upper plate 41, a downwardly facing lateral edge surface 46 on the lower plate 42 and a plurality of outwardly extending ribs 48. One or both of the lateral edge surfaces 44, 46 may be tapered or beveled as shown in FIG. 3, or may have other orientations, such as horizontal or reverse tapered, as necessary to form complimentary relationships with corresponding surfaces of the hull support ring 30 and the clamp ring 32, and with the seals 36, 38 of the hull seal assembly 14 to secure the drive unit 12 without substantially leakage. The ribs 48 may be spaced about the periphery of the outwardly extending retention portion 43 at locations corresponding to recesses of the clamp ring 32 that are illustrated and described in greater detail hereinafter.

Figure 4:
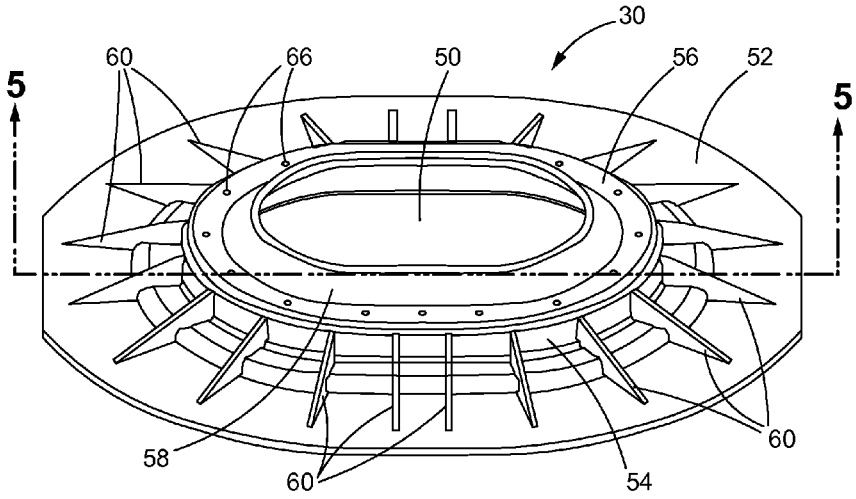
FIG. 4 is a perspective view of an embodiment of a hull support ring of the hull seal assembly of FIG. 2.

The hull support ring 30 as illustrated in FIG. 4 may be generally oval-shaped to correspond to the shape of the opening 16 in the boat hull 10. The hull support ring 30 may be a separate, unitary component that is fabricated and subsequently mounted to the boat hull 10 about the opening 16 with suitable fasteners and sealing mechanism to prevent leakage through the interface between the hull support ring 30 and the bottom 18 of the boat hull 10. In one exemplary implementation, the hull support ring 30 may be preformed or premolded separately from the fabrication of the boat hull 10. After both components 10, 30 are formed, the hull support ring 30 is set in place at the opening 16 and permanently bonded by glue or other fastening mechanism to the boat hull 10. Alternatively, the hull support ring 30 may be integrally formed with the boat hull 10 as a single, unitary component. For example, the hull support ring 30 may be fiberglassed in a hull mold and formed as one component with the boat hull 10 as the boat hull 10 is formed. The hull support ring 30 defines a central opening 50 sized and shaped to receive the upper gear housing section 24 of the drive unit 12 when the drive unit 12 is install in the boat hull 10. A lower generally horizontal outwardly extending flange 52 may provide a surface for attachment of the hull support ring 30 to the boat hull 10, or may form a portion of the bottom 18 of the boat hull 10 where the components are integrally formed.

Figure 5:
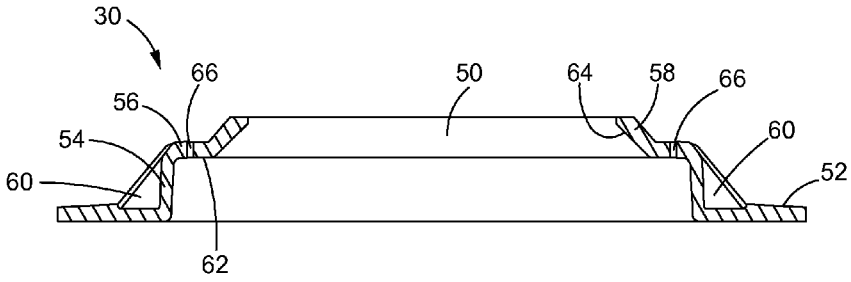
FIG. 5 is a cross-sectional view taken through line 5-5 in FIG. 4 of the hull support ring.

As more clearly shown in the cross-section of FIG. 5, the hull support ring 30 may further include a upwardly extending generally vertical flange portion 54 extending upwardly from the outwardly extending flange 52, an inwardly extending generally horizontal flange portion 56 extending inwardly from an upper edge of the flange portion 54, and a tapered flange portion 58 extending upwardly and inwardly from an inner edge of the inwardly extending flange portion 56. To provide additional structural support, the hull support ring 30 may further include a plurality of structural supports 60 spaced about the vertical flange portion 54 and extending between the vertical flange portion 54 and the outwardly extending flange 52. The generally horizontal flange portion 56 has a corresponding generally horizontal downwardly facing inner surface 62, and the tapered flange portion 58 has a corresponding downwardly facing support ring surface 64. The downwardly facing support ring surface 64 is illustrated as being tapered or beveled, but may be oriented closer to horizontal if necessary to cooperate with and match the orientation of the upwardly facing lateral edge surface 44 of the intermediate housing section 40 to retain the drive unit 12. Similarly, the downwardly facing inner surface 62 may be tapered or angled as necessary to cooperate with the corresponding surface of the clamp ring 32 as discussed more fully below. The generally horizontal flange portion 56 may also include a plurality of bores 66 passing there through and spaced about the flange portion 56 for receiving corresponding studs 34 for securing the clamp ring 32 to the hull support ring 30.

Figure 6:
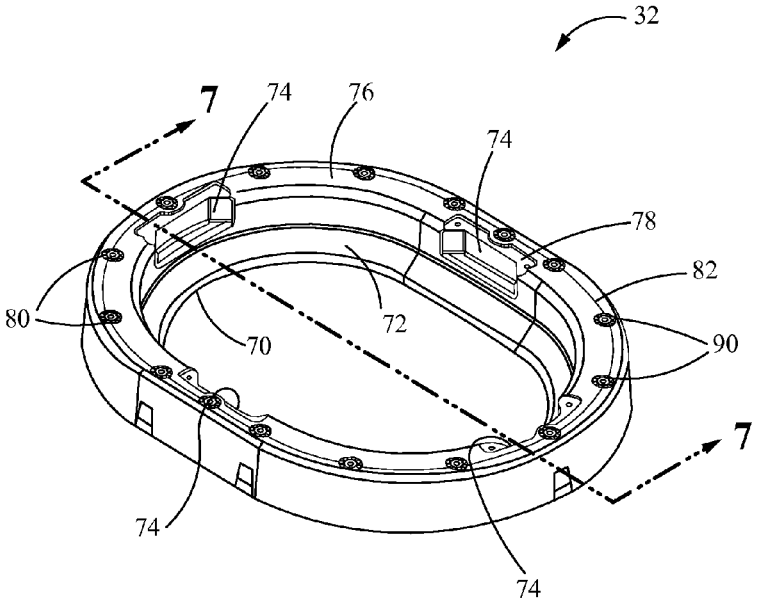
FIG. 6 is a perspective view of an embodiment of a clamp ring of the hull seal assembly of FIG. 2.
Figure 7:
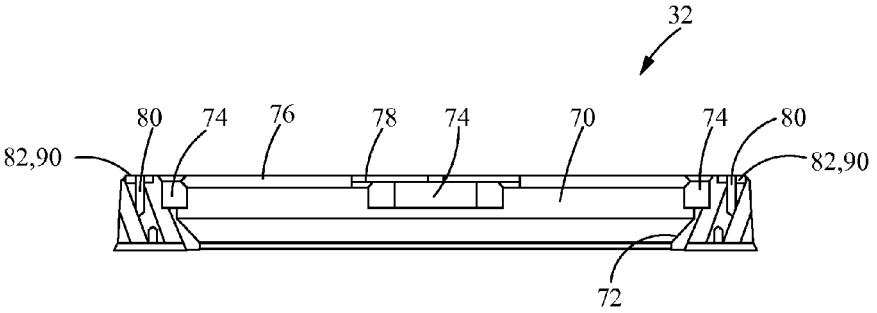
FIG. 7 is a cross-sectional view taken through line 7-7 in FIG. 6 of the clamp ring.

The clamp ring 32 has a shape corresponding to the shapes of the opening 16 in the boat hull 10 and the hull support ring 30 as shown in FIGS. 6 and 7. The clamp ring 32 is sized to be received by the hull support ring 30 within the boundary established by the upwardly extending flange portion 54. The clamp ring 32 has an opening 70 there through configured to be disposed about the intermediate housing section 40 of the drive unit 12. Within the opening 70, the clamp ring 32 includes an upwardly facing clamp ring surface 72. As best illustrated in the cross-section of FIG. 7, the upwardly facing clamp ring surface 72 may be tapered or beveled as necessary to have a complimentary shape to the downwardly facing lateral edge surface 46 of the intermediate housing section 40. However, the upwardly facing clamp ring surface 72 may be more generally horizontal if necessary for retention of the outwardly extending retention portion 43 within the hull seal assembly 14.

An upper portion of the opening 70 may include a plurality of rib receiving recesses 74 spaced about the clamp ring 32 at locations corresponding to the ribs 48 extending from the outwardly extending retention portion 43 of the intermediate housing section 40 as described above. At a generally horizontal upwardly facing surface 76 of the clamp ring 32, each rib receiving recess 74 may have an open upper end 78 allowing the corresponding rib 48 to be inserted therein during assembly of the intermediate housing section 40. After insertion of the ribs 48 into the rib receiving recesses 74, cover plates 92 (FIG. 10) may be installed to cover the open upper ends 78 of the rib receiving recesses 74 and retain the ribs 48 therein as will be discussed more fully below. The generally horizontal upwardly facing surface 76 of the clamp ring 32 may have a complimentary shape to the downwardly facing inner surface 62 of the hull support ring 30, and may include a plurality of bores 80 passing there through and spaced about the downwardly facing inner surface 62 at locations corresponding to the bores 66 of the hull support ring 30 for receiving corresponding studs 34 to secure the clamp ring 32 to the hull support ring 30.

Figure 8:
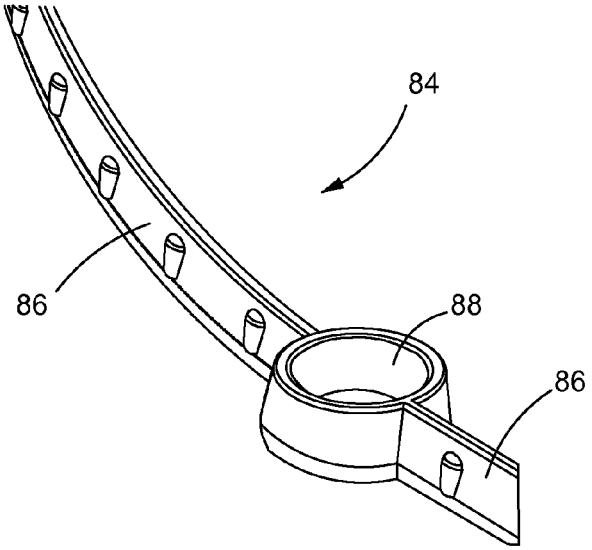
FIG. 8 is a perspective view of a portion of an embodiment of a clamp ring seal of the hull seal assembly of FIG. 2.

The upwardly facing surface 76 may further include a clamp ring seal recess 82 defined therein and surrounding the opening 70 of the clamp ring 32. The clamp ring seal recess 82 may be shaped to receive a clamp ring seal 84, a portion of which is shown in FIG. 8. The clamp ring seal 84 may be configured to accommodate the bores 66, 80 of the hull support ring 30 and the clamp ring 32, respectively, and studs 34 disposed therein to prevent leakage across the interface between the downwardly facing inner surface 62 and the upwardly facing surface 76. Consequently, the clamp ring seal 84 may be configured with alternating strap portions 86 and annular portions 88 that are spaced to correspond to bores 80 through the upwardly facing surface 76 of the clamp ring 32. Returning to FIGS. 6 and 7, the clamp ring seal recess 82 may include annular recess portions 90 surrounding the corresponding bores 80 and configured to receive corresponding annular portions 88 of the clamp ring seal 84 with the corresponding bores 80 encircled by the annular portions 88. The clamp ring seal recess 82 and the clamp ring seal 84 are dimensioned so that an upper edge of the clamp ring seal 84 extends above the upwardly facing surface 76 so that the clamp ring seal 84 engages the downwardly facing inner surface 62 of the hull support ring 30 when the clamp ring 32 is secured thereto to form a substantially water-tight seal there between.

Figure 9:
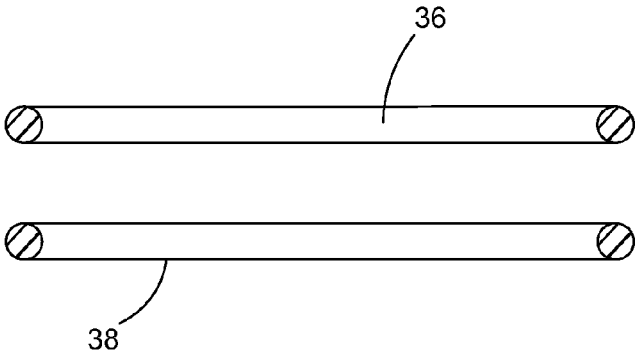
FIG. 9 is cross-sectional views of upper and lower ring seals of the hull seal assembly of FIG. 2.

FIG. 9 illustrates exemplary embodiments of the upper ring seal 36 and the lower ring seal 38 shown in cross-section. The ring seals 36, 38 may be formed from a resilient elastomeric material, and have complimentary shapes in horizontal projection to the hull support ring 30, the clamp ring 32 and to the outwardly extending retention portion 43 of the intermediate housing section 40. As shown, the ring seals 36, 38 may have circular cross-sections in their normal configuration and not compressed between complimentary surfaces to form seals there between. However, those skilled in the art will understand that the ring seals 36, 38 may have alternative cross-section shapes as necessary to form adequate seals between the complimentary surfaces.

INDUSTRIAL APPLICABILITY

Figure 10:
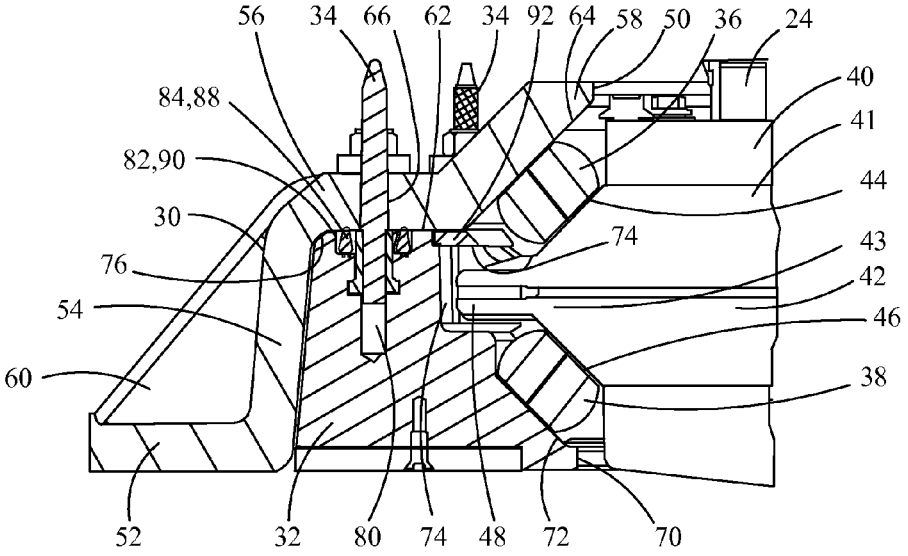
FIG. 10 is an enlarged view of left portion of the hull seal assembly as viewed in FIG. 2.

With reference to FIGS. 2 and 10, installation of the hull seal assembly 14 may be initiated during the assembly of the drive unit. As the intermediate housing section 40 is assembled to the underwater housing section 20, the clamp ring 32 may be positioned between the housing sections 20, 40. The clamp ring 32 is disposed around the intermediate housing section 40 and below the outwardly extending retention portion 43 with the upwardly facing clamp ring surface 72 facing the downwardly facing lateral edge surface 46 of the outwardly extending retention portion 43. At the same time, the lower ring seal 38 may also be installed around the intermediate housing section 40 and below the ribs 48 and the downwardly facing lateral edge surface 46. With the lower ring seal 38 in place between the downwardly facing lateral edge surface 46 and the upwardly facing clamp ring surface 72, the ribs 48 may be inserted through the open upper ends 78 of the corresponding rib receiving recesses 74 to align the outwardly extending retention portion 43 of the intermediate housing section 40 with the clamp ring 32. The lower ring seal 38 may be partially compressed between the downwardly facing lateral edge surface 46 and the upwardly facing clamp ring surface 72, and cover plates 92 may be attached to the clamp ring 32 at the open upper end 78 of each of the rib receiving recesses 74 to retain the ribs 48 and correspondingly retain the clamp ring 32 in position relative to the intermediate housing section 40.

With the clamp ring 32 installed on the drive unit 12, the drive unit 12 and the clamp ring 32 may be installed in the opening 16 through the bottom 18 of the boat hull 10. Before inserting the input shaft 26, the input flange 27 and the gear housing section 24 of the drive unit 12 through the opening 50 of the hull support ring 30, the upper ring seal 36 may be placed over the gear housing section 24 and down onto the upwardly facing lateral edge surface 44 of the outwardly extending retention portion 43. Once the upper ring seal 36 is in place, the input shaft 26 and the gear housing section 24 are inserted through the opening 50 of the hull support ring 30. The gear housing section 24 is inserted through the opening 50 until the outwardly extending retention portion 43 enters the hull support ring 30 and the upper ring seal 36 is engaged by the downwardly facing support ring surface 64 and the downwardly facing inner surface 62 faces and engages the upwardly facing surface 76 of the clamp ring 32. At this point, the downwardly facing inner surface 62 is engaged by the upper edge of the clamp ring seal 84. The studs 34 are then installed in corresponding pairs of bores 66, 80 to secure the clamp ring 32 to the hull support ring 30 and complete the installation of the drive unit 12 within the opening 16 in the bottom 18 of the boat hull 10.

When the clamp ring 32 is secured to the hull support ring 30, the ring seals 36, 38 are compressed to form upper and lower substantially water-tight seals. Compression of the ring seals 36, 38 causes the ring seals 36, 38 to deform to match the shapes of the surfaces applying pressure to the ring seals 36, 38. Consequently, the tapered and generally parallel surfaces 44, 64 cause the upper ring seal 36 to have generally parallel upper and lower sides and rounded ends. Similarly, the lower ring seal 38 has generally parallel upper and lower sides matching the shapes of generally parallel surfaces 46, 72.

As most clearly apparent from FIG. 10, the heights of the rib receiving recesses 74 are larger than the heights of the ribs 48 disposed therein. As a result, the ribs 48 may essentially float within the rib receiving recesses 74 and the hull seal assembly 14 may allow an amount of upward and downward movement of the ribs 48 and, correspondingly, the drive unit 12 relative to the boat hull 10. Consequently, the drive unit 12 may move vertically in response to upward and downward forces applied thereto. Moreover, the hull seal assembly 14 will allow for an amount of rotation of the drive unit 12 about horizontal axes. As a rib 48 moves upwardly or downwardly, the portion of one of the ring seals 36, 38 proximate the rib 48 and in the direction of movement of the rib 48 may further compress, while the portion of the other ring seal 36, 38 may partially decompressed as the outwardly extending retention portion 43 moves within the hull seal assembly 14 but maintains contact with the corresponding surfaces. The ribs 48, rib receiving recesses 74 and cover plates 92 may also provide mechanical hard stops that prevent over-compression of the ring seals 36, 38 and prevent the ring seals 36, 38 from sliding out of position during extreme loading events where the underwater housing section 20 hits an object in the water at any speed. Consequently, the substantially water-tight seal of the hull seal assembly 14 may be maintained as the drive unit 12 moves relative to the boat hull 10. In a similar manner, the rib receiving recesses 74 may be wider than the corresponding ribs 48 such that an amount of rotation of the drive unit 12 about a vertical axis is possible without compromising the integrity of the water-tight seal of the hull seal assembly 14 to allow leakage of water into the inboard compartment of the boat hull 10. Though illustrated herein as having the ribs 48 extending from the outwardly extending retention portion 43 of the intermediate housing section 40, those skilled in the at will understand that the ribs 48 may extend from other locations on the drive unit 12, and the rib receiving recesses 74 may be defined in the clamp ring 32, the hull support ring 30 or any other appropriate structure of the boat hull 10 or hull seal assembly 14 to perform the necessary retention and compression preventive functions described herein.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A boat hull with a bottom-mounted drive unit for at least one propeller, comprising:

a lower housing section of the bottom-mounted drive unit;

an upper housing section of the bottom-mounted drive unit;

an intermediate housing section of the bottom-mounted drive unit disposed between the lower housing section and the upper housing section, the intermediate housing section having an outwardly extending retention portion;

a hull support ring mounted to a bottom of the boat hull and surrounding an opening through the bottom of the boat hull, the hull support ring having a downwardly facing support ring surface; and a clamp ring fastened to the hull support ring and having an upwardly facing clamp ring surface, wherein the outwardly extending retention portion is disposed between the downwardly facing support ring surface and the upwardly facing clamp ring surface to retain the outwardly extending retention portion of the bottom-mounted drive unit within the hull support ring.

2. The boat hull with a bottom-mounted drive unit of claim 1, wherein the downwardly facing support ring surface is tapered and the outwardly extending retention portion comprises a tapered upwardly facing lateral edge surface facing the downwardly facing support ring surface.

3. The boat hull with a bottom-mounted drive unit of claim 1, wherein the upwardly facing clamp ring surface is tapered and the outwardly extending retention portion comprises a tapered downwardly facing lateral edge surface facing the upwardly facing clamp ring surface.

4. The boat hull with a bottom-mounted drive unit of claim 1, comprising an upper ring seal disposed between the downwardly facing support ring surface and the outwardly extending retention portion.

5. The boat hull with a bottom-mounted drive unit of claim 1, comprising a lower ring seal disposed between the upwardly facing clamp ring surface and the outwardly extending retention portion.

6. The boat hull with a bottom-mounted drive unit of claim 1, comprising:

a plurality of ribs extending outwardly from the bottom-mounted drive unit; and a plurality of rib receiving recesses in the clamp ring, with each of the plurality of rib receiving recesses having a corresponding one of the plurality of ribs disposed therein.

7. The boat hull with a bottom-mounted drive unit of claim 6, comprising a plurality of cover plates, with each of the plurality of cover plates mounted to the clamp ring at an open upper end of a corresponding one of the plurality of rib receiving recesses to retain the corresponding one of the plurality of ribs therein.

8. The boat hull with a bottom-mounted drive unit of claim 1, wherein the hull support ring comprises an inwardly extending flange portion having a generally horizontal downwardly facing inner surface, and the clamp ring comprises a generally horizontal upwardly facing surface facing and engaging the generally horizontal downwardly facing inner surface when the clamp ring is fastened to the hull support ring.

9. The boat hull with a bottom-mounted drive unit of claim 8, comprising a clamp ring seal disposed between the generally horizontal downwardly facing inner surface and the generally horizontal upwardly facing surface and forming a substantially water-tight seal there between.

10. The boat hull with a bottom-mounted drive unit of claim 1, wherein the hull support ring is integrally formed with the bottom of the boat hull.

11. A bottom-mounted drive unit for installation in an opening of a boat hull, comprising:

a lower housing section;

an upper housing section;

an intermediate housing section disposed between the lower housing section and the upper housing section and having an outwardly extending retention portion with an upwardly facing lateral edge surface and a downwardly facing lateral edge surface, wherein the upwardly facing lateral edge surface and the downwardly facing lateral edge surface are engaged by a hull seal assembly to retain the bottom-mounted drive unit within the opening of the boat hull; and a plurality of ribs extending outwardly from the bottom-mounted drive unit, each of the plurality of ribs being received by a corresponding rib receiving recess of the hull seal assembly.

12. The bottom-mounted drive unit according to claim 11, wherein the upwardly facing lateral edge surface is tapered and the downwardly facing lateral edge surface is tapered.

13. The bottom-mounted drive unit according to claim 11, wherein the intermediate housing section comprises:

an upper plate having the upwardly facing lateral edge surface; and a lower plate connected to the upper plate and having the downwardly facing lateral edge surface.

14. The bottom-mounted drive unit according to claim 13, wherein the upper plate and the lower plate are fabricated from different materials.

15. A boat hull with a bottom-mounted drive unit for at least one propeller, comprising:

a lower housing section of the bottom-mounted drive unit;

an upper housing section of the bottom-mounted drive unit;

an intermediate housing section of the bottom-mounted drive unit disposed between the lower housing section and the upper housing section, the intermediate housing section having an outwardly extending retention portion with a tapered upwardly facing lateral edge surface and a tapered downwardly facing lateral edge surface;

a hull support ring mounted to a bottom of the boat hull and surrounding an opening through the bottom of the boat hull, the hull support ring having a tapered downwardly facing support ring surface;

a clamp ring fastened to the hull support ring and having a tapered upwardly facing clamp ring surface, wherein the outwardly extending retention portion is disposed between the tapered downwardly facing support ring surface and the tapered upwardly facing clamp ring surface to retain the outwardly extending retention portion of the bottom-mounted drive unit within the hull support ring with the tapered downwardly facing support ring surface facing the tapered upwardly facing lateral edge surface of the outwardly extending retention portion and the tapered upwardly facing clamp ring surface facing the tapered downwardly facing lateral edge surface of the outwardly extending retention portion;

an upper ring seal disposed between the tapered downwardly facing support ring surface and the tapered upwardly facing lateral edge surface; and a lower ring seal disposed between the tapered upwardly facing clamp ring surface and the tapered downwardly facing lateral edge surface.

16. The boat hull with a bottom-mounted drive unit of claim 15, comprising:

a plurality of ribs extending outwardly from the outwardly extending retention portion; and a plurality of rib receiving recesses in the clamp ring, with each of the plurality of rib receiving recesses having a corresponding one of the plurality of ribs disposed therein.

17. The boat hull with a bottom-mounted drive unit of claim 16, comprising a plurality of cover plates, with each of the plurality of cover plates mounted to the clamp ring at an open upper end of a corresponding one of the plurality of rib receiving recesses to retain the corresponding one of the plurality of ribs therein.

18. The boat hull with a bottom-mounted drive unit of claim 15, wherein the hull support ring comprises an inwardly extending flange portion having a generally horizontal downwardly facing inner surface, and the clamp ring comprises a generally horizontal upwardly facing surface facing and engaging the generally horizontal downwardly facing inner surface when the clamp ring is fastened to the hull support ring.

19. The boat hull with a bottom-mounted drive unit of claim 15, wherein the hull support ring is integrally formed with the bottom of the boat hull.

* * * * *